US007026565B1

(12) United States Patent
Lee

(10) Patent No.: US 7,026,565 B1
(45) Date of Patent: Apr. 11, 2006

(54) SELF-CONTAINED ACTUATOR SUBASSEMBLY FOR A ROCKER SWITCH AND ROCKER SWITCH EMPLOYING THE SAME

(75) Inventor: Davin R. Lee, Watertown, WI (US)

(73) Assignee: Eaton Corporation, Cleveland, OH (US)

( * ) Notice: Subject to any disclaimer, the term of this patent is extended or adjusted under 35 U.S.C. 154(b) by 73 days.

(21) Appl. No.: 11/023,235

(22) Filed: Dec. 27, 2004

(51) Int. Cl.
*H01H 13/00* (2006.01)
*H01H 3/00* (2006.01)

(52) U.S. Cl. ..... 200/339; 200/5 R; 200/553

(58) Field of Classification Search ..... 200/339, 200/329, 5 R, 6 A, 553, 557, 559
See application file for complete search history.

(56) References Cited

U.S. PATENT DOCUMENTS 4,024,367 A 5/1977 Kodaira et al.
4,221,941 A 9/1980 Genovese
4,321,442 A 3/1982 Tanaka et al.
4,528,431 A 7/1985 Coleman, III
4,697,053 A 9/1987 Lockard
4,803,317 A * 2/1989 Sutoh et al. ..... 200/438
5,053,591 A 10/1991 Theurer
5,158,172 A * 10/1992 Roeser et al. ..... 200/553
5,693,920 A * 12/1997 Maeda ..... 200/1 B
5,810,109 A 9/1998 Chu
5,880,419 A * 3/1999 Chou ..... 200/6 R
6,339,201 B1 1/2002 Balaban et al.
6,380,500 B1 4/2002 Lin
6,459,060 B1 * 10/2002 Bartok ..... 200/553
6,545,239 B1 4/2003 Spedale et al.
6,576,855 B1 6/2003 Levendis et al.

* cited by examiner

*Primary Examiner*—K. Lee

(57) ABSTRACT

An actuator subassembly is for a rocker switch. The actuator subassembly forms a self-contained unit removably inserted within the rocker switch to define the operating characteristics thereof. The actuator subassembly includes an operating member operable between a plurality of positions, an extension and a spring-biased plunger. A shaped member which is pivotally coupled to the operating member includes a plurality of shaped sections each corresponding to one of the positions of the operating member. Each shaped section has a profile which is designed to provide the desired rocker switch operating characteristics, such as the type of action of the operating member and the operating force for the operating member.

23 Claims, 5 Drawing Sheets

2/5

SELF-CONTAINED ACTUATOR SUBASSEMBLY FOR A ROCKER SWITCH AND ROCKER SWITCH EMPLOYING THE SAME

BACKGROUND OF THE INVENTION

1. Field of the Invention

The present invention relates generally to electrical switching apparatus and, more particularly, to actuator subassemblies for rocker switches. The invention also relates to rocker switches including actuator subassemblies.

2. Background Information

Rocker switches are generally old and well known in the art. As shown in FIG. 1, a rocker switch 2 generally includes a housing 4 and an actuator, such as the pivotal button or operating member 6, shown, which can be actuated from the exterior of the housing 4. The housing 4 is typically made from a non-conductive material, such as a heat-resistant plastic, and is structured to define a cavity 8. At the base 10 of the housing 4 are a plurality of terminals (e.g., the rocker switch 2 of FIG. 1 has first, second and third terminals 12, 14, 16). Typically, the first and third terminals 12, 16 are load terminals and the second or middle terminal 14 is the line terminal. Each terminal 12, 14, 16 extends from outside the housing 4 into the cavity 8. At least one of the terminals 12, 14, 16 is electrically connected to a stationary contact disposed within the housing cavity 8. In the example of FIG. 1, one stationary contact 18 is coupled to first terminal 12 and a second stationary contact 20 is coupled to third terminal 16. Movable contacts 22, 24 coupled to opposite ends of a shaped member, such as the deflective conductor 26, shown, are structured to engage the stationary contacts 18, 20.

The profile of the deflective conductor 26 dictates the operating characteristics (e.g., without limitation, type of action, such as, momentary or sustained; number and location of positions of the operating member; operating forces) of the rocker switch 2. Specifically, the operating member 6 includes a spring 28 adapted to push on a plunger 30 which, in turn, slides over the surface of the shaped member 26 as the operating member 6 is moved, in order to, for example, open and close the electrical contacts 20, 24 or 18, 22 (e.g., stationary contact 18 and movable contact 22 of FIG. 1 are closed, while contacts 20, 24 are open).

It is often desirable to change one or more of these operating characteristics after the rocker switch 2 has been assembled and installed into the final product. However, this is a costly and complicated endeavor and, in many instances, it cannot be accomplished without entirely disassembling the product and replacing the entire rocker switch 2.

The rocker switch button or operating member of certain known prior art rocker switches can be changed or replaced fairly easily. See, e.g., U.S. Pat. No. 5,053,591 (disclosing a rocker switch having interchangeable handles for the purpose of blending the handle with the new decor of a room). However, there remains a strong desire to be able to also change the operating characteristics (e.g., positions of the operating member; number of positions of the operating member; operating forces; types of action) of the switch without having to replace the entire switch assembly.

There is, therefore, room for improvement in rocker switches and in actuator subassemblies therefore.

SUMMARY OF THE INVENTION

These needs and others are satisfied by the present invention, which is directed to an actuator subassembly which may be interchangeably employed in a variety of electrical switchgear applications in order to change one or more switchgear operating characteristics (e.g., positions of the operating member; number of positions of the operating member; operating forces; types of action). The actuator subassembly provides a self-contained removable unit including all of the components necessary to define the type of switch and operating characteristics thereof.

As one aspect of the invention, an actuator subassembly is for a rocker switch including a housing defining a cavity with an opening which provides access thereto, a plurality of terminals which extend from outside the housing into the cavity and a contact element coupled to at least one of the terminals within the cavity. The actuator subassembly comprises: an operating member operable between a plurality of positions, the operating member including an extension with an internal bore, the extension structured for insertion through the opening in the housing into the cavity thereof, a plunger adapted for slidable insertion within the internal bore of the extension; a shaped member pivotally coupled to the operating member and structured to define a plurality of operating characteristics thereof, including defining the positions thereof; a spring disposed within the internal bore of the extension, the spring adapted to bias the plunger against the shaped member, in order that the plunger engages and moves the shaped member when the operating member is moved among the positions; and a contacting part coupled to the shaped member and structured to move therewith in order to engage the contact element of the rocker switch when the operating member is in a first one of the positions. The operating member, the plunger, the spring, the shaped member and the contacting part may form a self-contained unit structured to be removably inserted through the opening of the housing into the cavity thereof.

The shaped member and the contacting part may be operable between a first closed position in which the contacting part engages the contact element, and an open position in which the contacting part is spaced apart from the contact element. The first closed position of the shaped member corresponds to the first one of the positions of the operating member, and the open position corresponds to another one of the positions.

The operating characteristics of the operating member may be selected from the group consisting of the positions of the operating member, operating forces of the operating member and types of action of the operating member. The shaped member may include at least two shaped sections corresponding to at least two of the positions of the operating member wherein each of the at least two shaped sections has a profile which dictates the operating characteristics associated with the corresponding operating member position. Each of the at least two positions may have an operating action selected from the group consisting of sustained and momentary and the profile of each of the shaped sections may dictate whether the operating action for each of the at least two positions is sustained or momentary.

The at least two positions may be first and second operating member positions wherein the first and second operating member positions have operating actions selected from the group consisting of a combination of two momentary actions, a combination of two sustained actions and a combination of momentary and sustained actions, respectively.

The at least two operating member positions may be first, second and third operating member positions wherein the first, second and third operating member positions have operating actions selected from the group consisting of a combination of three sustained actions, a combination of two sustained actions and one momentary action and a combination of two momentary actions and one sustained action, respectively.

The extension of the operating member may include an aperture extending therethrough wherein the shaped member includes a pivotal portion structured to engage the aperture, in order to pivotally couple to the extension and move therewith.

The contact element may be a switch and the actuator subassembly may include a printed circuit board (PCB) in electrical communication with the switch. Alternatively, the contacting part may be a conductor and the contact element may be a stationary contact wherein the shaped member and conductor thereon move into and out of electrical communication with the stationary contact.

As another aspect of the invention, a rocker switch comprises: a housing defining a cavity and including an opening which provides access thereto; a plurality of terminals extending from outside the housing into the cavity therein; a contact element coupled to at least one of the terminals within the cavity; and an actuator subassembly comprising: an operating member operable between a plurality of positions, the operating member including an extension with an internal bore, the extension structured for insertion through the opening in the housing into the cavity thereof; a plunger adapted for slidable insertion within the internal bore of the extension; a shaped member pivotally coupled to the operating member and defining a plurality of operating characteristics thereof, including defining the plurality of positions thereof; a spring disposed within the internal bore of the extension, the spring biasing the plunger against the shaped member, in order that the plunger engages and moves the shaped member when the operating member is moved among the positions; and a contacting part coupled to the shaped member and movable therewith in order to engage the contact element of the rocker switch when the operating member is in a first one of the positions. The operating member, the plunger, the spring, the shaped member and the contacting part may form a self-contained unit which is removably inserted through the opening of the housing into the cavity thereof.

The shaped member may include at least two shaped sections corresponding to at least two of the positions of the operating member wherein each of the at least two shaped sections has a profile which dictates the operating characteristics associated with the corresponding one of the at least two positions of the operating member.

The rocker switch housing may include at least one molded light pipe structured to illuminate the operating member.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

For purposes of illustration, the invention will be described as applied to rocker switches, although it will become apparent that it could also be applied to other types of electrical switching apparatus (e.g., without limitation, toggle switches) having an external operating member.

As employed herein, the term "fastener" refers to any suitable connecting or tightening mechanism expressly including, but not limited to, screws, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "operating characteristics" refers to the features of a rocker switch, expressly including, but not limited to, the type of operating member, the number of positions of the operating member, the location of positions of the operating member, types of action of the operating member (e.g., sustained, momentary and combinations thereof), operating forces, and the path of movement of the operating member.

As employed herein, the term "contacting part" refers to a portion of the exemplary shaped member which is structured to engage or contact and actuate, for example, a switch, as well as to an electrically conductive contactor, such as a conductor, which is either integral with or a separate component coupled to the shaped member.

As employed herein, the term "contact element" refers to the element engaged by the aforementioned contacting part. Specifically, the term refers not only to a stationary contact, but also to an electrical actuating mechanism, such as a switch. Switches contemplated by the present invention expressly include, but are not limited to, microswitches, rubber key pad switches, snap dome switches and tactile switches.

Figure 2:
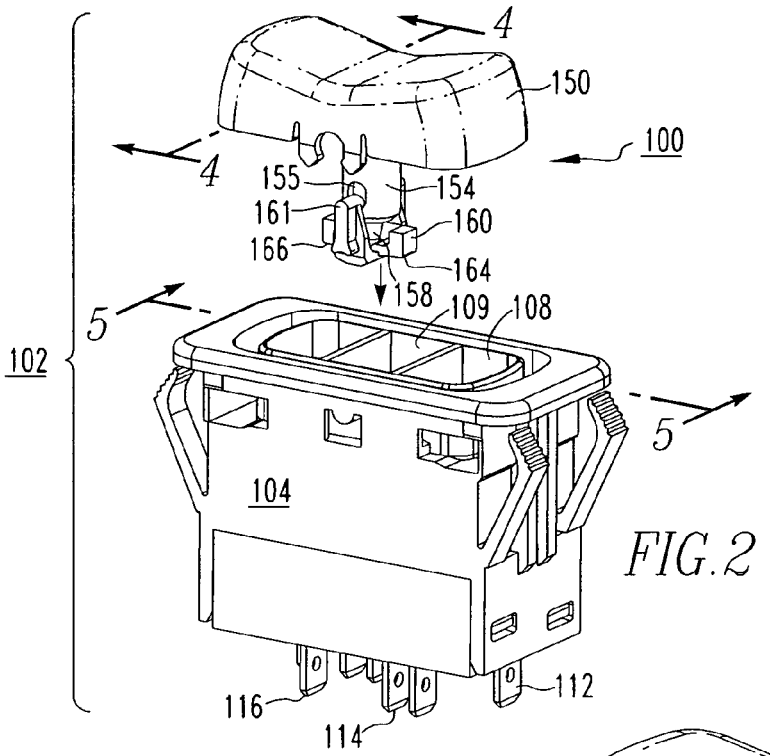
FIG. 2 is an exploded isometric view of a self-contained rocker switch actuator subassembly and housing therefore, in accordance with the present invention.
Figure 5:
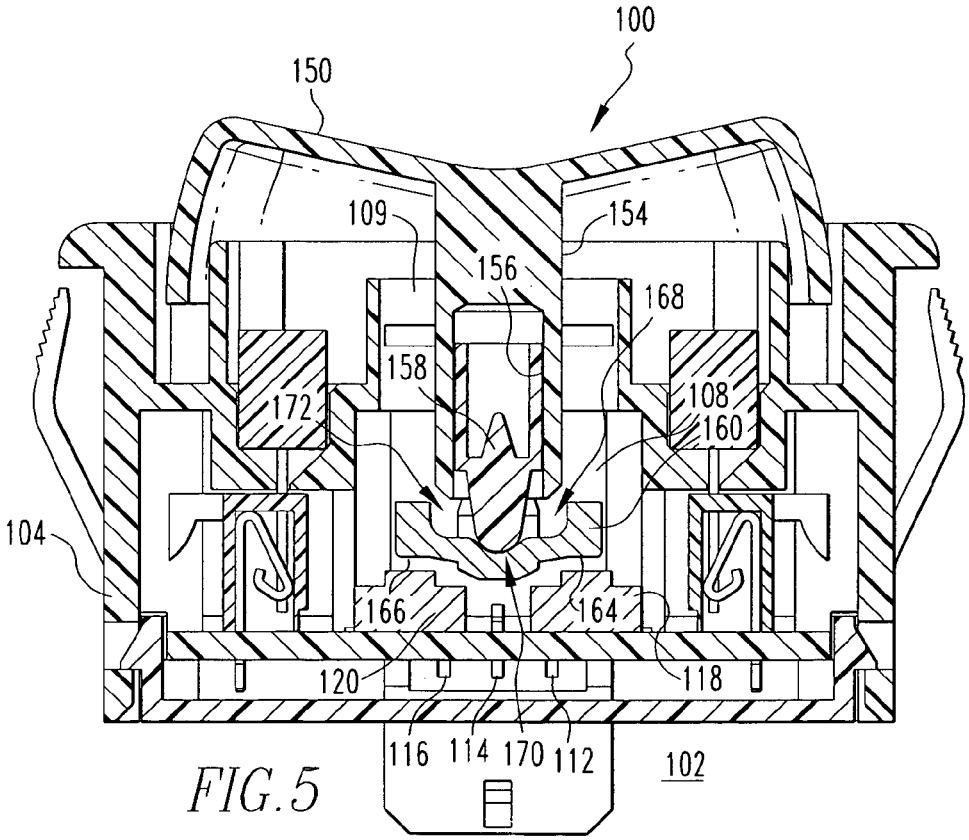
FIG. 5 is an assembled, cross-sectional view of the rocker switch assembly of FIG. 2 taken along line 5—5 of FIG. 2.

FIG. 2 shows an actuator subassembly 100 for a rocker switch 102. The rocker switch 102 includes a housing 104 defining a cavity 108 with an opening 109 which provides access thereto. A plurality of terminals, such as first, second and third terminals 112, 114, 116, respectively, extend from outside the housing 104 into the cavity 108. One or more contact elements 118, 120 (best shown in FIG. 5) are coupled to at least one of the first, second and third terminals 112, 114, 116 within the cavity 108 (FIG. 5). The contact elements may include switches 118, 120, such as microswitches (best shown in FIG. 5) or it may include stationary contacts (see, e.g., stationary contacts 218, 220 of FIGS. 9 and 10).

Figure 3:
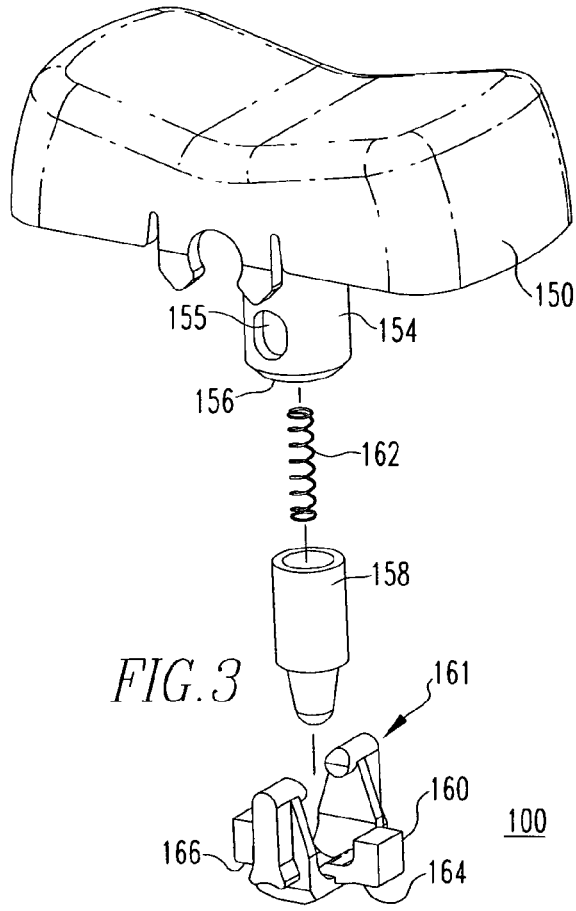
FIG. 3 is an exploded, isometric view of the self-contained actuator subassembly of FIG. 2.
Figure 4:
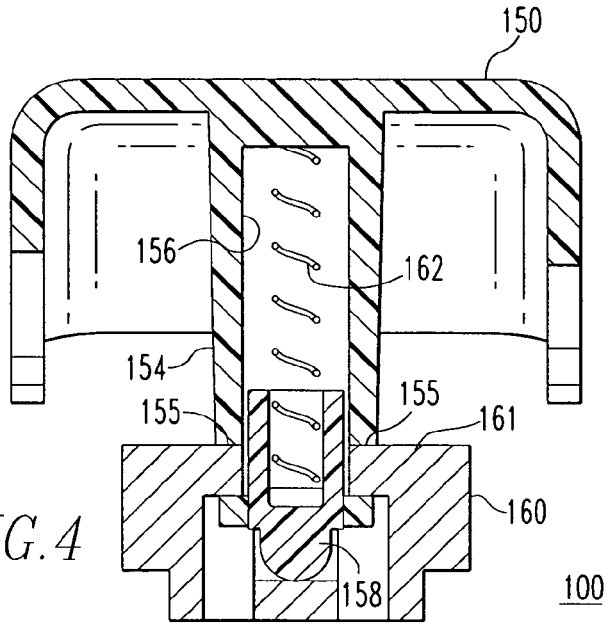
FIG. 4 is a cross-sectional view of the self-contained actuator subassembly taken along line 4—4 of FIG. 2.

As shown in FIGS. 2–4, the actuator subassembly 100 includes an operating member 150 having an extension 154 with an internal bore 156. As shown in the exploded view of FIG. 2, the extension 154 is structured for insertion through the opening 109 in the housing 104 in order to extend into the cavity 108 thereof (best shown in the assembled view of FIG. 5). A plunger 158 is adapted for slidable insertion within the internal bore 156 of the extension 154. A shaped member 160 is pivotally coupled to the operating member 150 and structured to define a plurality of operating characteristics thereof, including defining the positions thereof. A spring 162 disposed within the internal bore 156 of the extension 154 is adapted to bias the plunger 158 against the shaped member 160, in order that the plunger 158 engages and moves the shaped member 160 when the operating member 150 is moved among the positions.

Figure 6A:
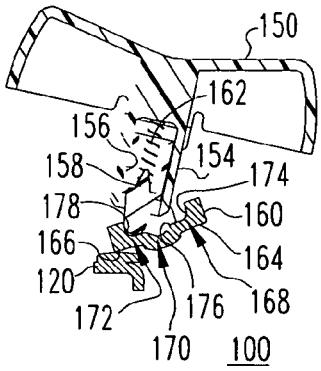
FIGS. 6A, 6B and 6C are cross-sectional views of a three-position self-contained rocker switch subassembly each showing sustained actions in accordance with an embodiment of the present invention.

As shown in the cross-sectional view of FIG. 5, the shaped member 160 includes one or more contacting parts 164,166 structured to move therewith in order to engage the one or more contact elements 118, 120 of the rocker switch 102 when the operating member 150 is in a first one of the positions (see, e.g., FIG. 6A). In FIG. 5, the operating member 150 and shaped member 160 coupled thereto are in the neutral position in which none of the contacting parts 164, 166 is contacting any of the contact elements 118, 120 (see also, FIG. 6B). As previously discussed, the contacting parts (e.g., 164,166) may be a portion of shaped member 160 for contacting the contact element (e.g., 118,120), or they may be conductors (see, e.g., conductors 264,266 for contacting contacts 218,220 in FIGS. 9 and 10).

Figure 6B:
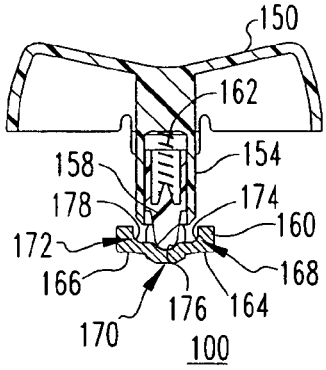
Figure 6C:
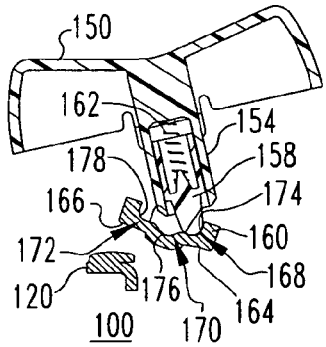

Referring to FIGS. 6A, 6B and 6C, sequentially, the shaped member 160 and contacting part 166 thereof, are operable between a first closed position in which the contacting part 166 engages the contact element 120 (shown in phantom line drawing in FIG. 6A), and an open position in which the contacting part 166 is spaced apart from the contact element 120 (FIG. 6C). For ease of illustration, only one contact element 120 is shown in FIGS. 6A and 6C. A stationary contact 120 is shown. However, it will be appreciated that the contact element could alternatively be a switch (see, e.g., switches 118,120 of FIG. 5). The first closed position (FIG. 6A) of the shaped member 160 corresponds to the first one of the plurality of positions of the operating member 150 and the open position (FIG. 6C) corresponds to another one of those positions.

As previously discussed, the operating member 150, plunger 158, spring 162, shaped member 160 and the contacting parts 164, 166 coupled thereto form the self-contained unit removeably inserted through the opening 109 of the housing 104 into the cavity 108 thereof (FIG. 5). Specifically, as best shown in FIGS. 2 and 3, the extension 154 of the operating member 150 includes an aperture 155 extending therethrough. The shaped member 160 includes a pivotal portion 161 which is structured to engage the aperture 155, in order to pivotally couple to the extension 154 and move therewith. Although the exemplary pivotal portion 161 comprises a pair of opposing molded tabs, as shown in FIG. 3, it will be appreciated that any suitable pivot mechanism, such as a fastener (not shown), could alternatively be used to make the pivotal connection. In this manner, the operating member 150 may move among the plurality of positions while pivoting the shaped member 160 to the corresponding position. The pivotal relationship between the operating member 150 and shaped member 160 will now be discussed in greater detail.

As shown in FIGS. 6A–6C, 7A–7C, 8A and 8B, the shaped member 160,160',160" includes shaped sections 168, 170, 172, 168', 170', 172', 168", 170" corresponding to the positions of the operating member 150. Each of the shaped sections 168,170,172, 168', 170', 172', 168", 170" has a profile 174, 176, 178, 174', 176', 178', 174", 176", respectively, which dictates the operating characteristics associated with the corresponding one of the positions of the operating member 150. The operating characteristics expressly include, without limitation, positions of the operating member 150, operating forces of the operating member 150 and types of action of the operating member 150. Each of the operating member positions has an operating action which is either sustained or momentary. A sustained action is one in which the position of the operating member 150 is maintained until an external force is applied to the operating member 150 in order to overcome it. The sustained position of operating member 150 is made possible by the profile (e.g., profile 178 of FIG. 6A) of the shaped member 160 which is curved to receive and temporarily maintain the correspondingly curved end of plunger 158. Conversely, a momentary action is one which is only maintained if a continuous external force is applied to the operating member 150. As soon as the force is removed, the operating member 150 will return to a sustained position (see, e.g., FIG. 7B). In summary, the profile 174,176,178,174',176',178',174", 176" of each respective shaped section 168,170,172,168', 170',172',168",170" dictates whether the operating actions for the corresponding operating member positions will be sustained or momentary.

FIGS. 6A, 6B and 6C show an actuator subassembly 100 in which there are three operating member positions each of which has a sustained action. Specifically, the shaped member 160 includes three shaped sections 168,170,172 each having a profile 174,176,178, respectively, which is shaped to receive the plunger 158 and maintain it in a sustained position. Accordingly, FIGS. 6A, 6B and 6C sequentially show three sustained positions ranging from one extreme (FIG. 6A) wherein the shaped member is pivoted to a first sustained position in which movable contacting part 166 is in electrical communication with contact element 120 (shown in phantom line drawing). Such an operating member position may correspond, for example, without limitation, to a forward operating mode of the electrical apparatus (not shown) in which the rocker switch 102 (FIG. 5) is installed. In such an example, FIG. 6B represents a sustained neutral or OFF position in which neither of the contacting parts 164,166 is engaging a contact element 118,120, and FIG. 6C corresponds to, for example, an operating member position actuating the reverse mode of the electrical apparatus (not shown). The forward, OFF and reverse modes of the example of FIGS. 6A, 6B, 6C, respectively, are all sustained actions in which the corresponding operating member positions are maintained until a user manually overrides them by pivoting the operating member 150.

It will be appreciated that sustained positions could alternatively be used for a wide variety of other electrical apparatus (not shown) operating modes other than the forward and reverse example discussed herein. For example, it may be desirable to provide a rocker switch 102 (FIG. 5) which has a number of positions each corresponding to a different operating speed of the apparatus. For instance, an electrical apparatus, such as an egg beater (not shown) or an electric fan (not shown), may have low, high and OFF operating modes, each of which would be sustained. It will, therefore, be appreciated that alternative configurations of the shaped member 160 and the shaped sections 168,170, 172 and profiles 174,176,178 thereof, could be employed to achieve any suitable desired operating characteristic.

Figure 7A:
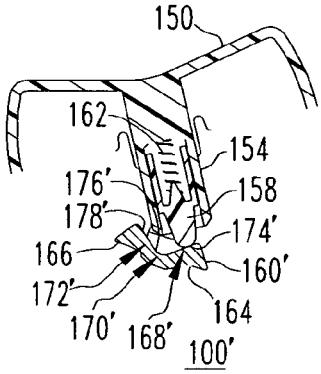
FIGS. 7A, 7B and 7C are cross-sectional views of a three-position self-contained rocker switch subassembly showing momentary, sustained and momentary actions, respectively, in accordance with another embodiment of the invention.
Figure 7B:
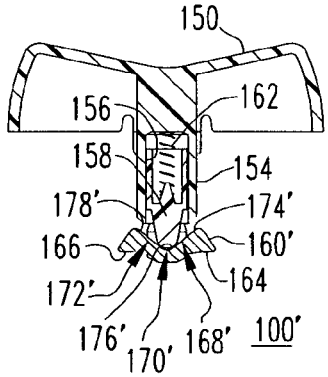
Figure 7C:
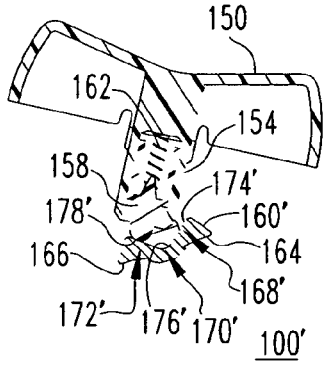

FIGS. 7A, 7B and 7C provide another example of an actuator subassembly 100' having three operating member positions. In this example, however, the first and third operating member positions shown in FIGS. 7A and 7C, respectively, are momentary positions while the second position of FIG. 7B is a sustained position. Such a configuration would typically be employed in an application in which it is desirable to only momentarily energize the electrical apparatus (not shown). For example, such an actuator configuration might be employed as an added safety measure wherein the operating member 150 must be held down in the desired momentary position (FIGS. 7A and 7C) in order to be able to perform a function using the electrical apparatus (not shown). By way of example, this might be employed in manufacturing environments where it is desired, for example, to require a worker to hold the switch down in order to keep the worker's hands in a safe location remote from a dangerous piece of machinery. Therefore, such a rocker switch 102 and actuator subassembly 100' therefor would function as a safety feature similar to safety handles and mechanisms currently employed on residential lawnmowers; (e.g., unless the safety handle is maintained in a closed momentary position, the lawnmower may not be operated).

The shaped sections 168',170',172' of the shaped member 160' have different profiles 174',176',178' than the sustained profiles 174,176,178 previously discussed in connection with FIGS. 6A, 6B and 6C which were shaped with a curve designed to receive and maintain the position of the curved plunger 158. Conversely, the profile for a momentary action is typically straight and sloped. For example, profiles 174' and 178' are sloped toward the central sustained profile 176' in FIGS. 7A, 7B and 7C. Accordingly, the spring biased plunger 158 engages the slope and will have a tendency to slide toward the center, sustained shaped section 170' (FIG. 7B) unless an external force is applied to the operating member 150 sufficient to momentarily overcome this tendency and maintain the position of the plunger 158 thereon (see, e.g., FIGS. 7A and 7C).

In addition to the types of action of the operating member 150, the shaped member 160' and profiles 174',176',178' thereof can be shaped and dimensioned to define other operating characteristics, as desired. For example, the amount of force required to operate the operating member 150 can be increased or decreased by increasing or decreasing, respectively, the slope of profiles 174' and 178'; (e.g., the steeper the slope toward the center sustained position (FIG. 7B), the more operating force must be applied to momentarily maintain the position of the operating member 150 (FIGS. 7A and 7C)).

Figure 8A:
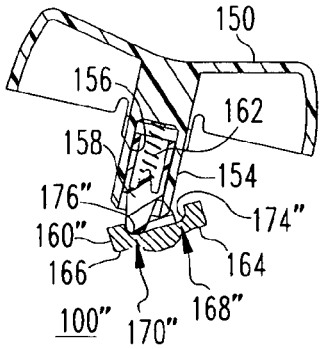
FIGS. 8A and 8B are cross-sectional views of a two-position self-contained rocker switch subassembly each showing sustained actions in accordance with another embodiment of the invention.
Figure 8B:
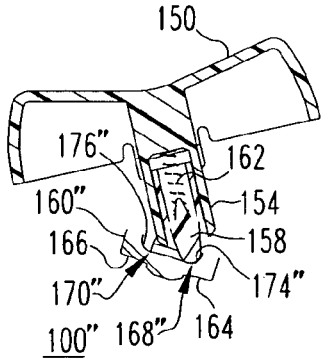

FIGS. 8A and 8B show another actuator subassembly 100" having two operating member positions which are sustained. A rocker switch 102 (FIG. 5) employing such an actuator subassembly 100" could be used, for example, in any application in which it is desired to provide the electrical apparatus (not shown) with two operating modes (e.g., without limitation, ON, OFF; forward, reverse; low, high). The shaped member 160", shaped sections 168",170" and profiles 174",176" thereof, are similar to the sustained shaped member 160 previously discussed with respect to FIGS. 6A, 6B and 6C. However, as shaped member 160" defines two operating member positions rather than the three positions of shaped member 160, there is no center shaped section 170 (FIG. 6A) and no profile 176 (FIG. 6A) therefor.

The embodiments shown and discussed in relation to FIGS. 6A–6C, 7A–7C, 8A and 8B merely present a few representative examples of the self-contained actuator subassembly 100,100',100",200 and rocker switch 102,202 (FIGS. 5 and 9) of the present invention. It will be appreciated, therefore, that a wide variety of operating member 150,250 and shaped member 160,160',160",260 configurations could alternatively be employed. For instance, any number of operating member positions, in any order or combination, could be employed other than the examples illustrated and discussed herein. Additionally, the shaped members illustrated and discussed herein could include different shape section profiles in any suitable combination in order to define any suitable, desired operating characteristic other than those shown and described herein.

Figure 9:
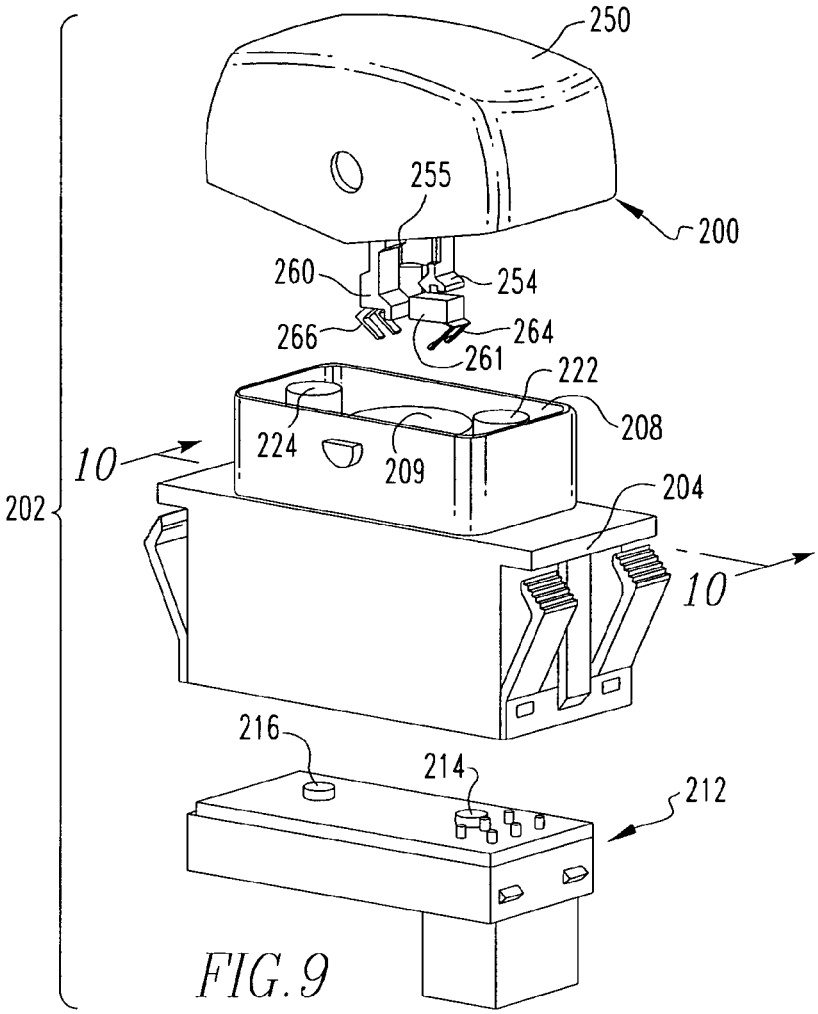
FIG. 9 is an exploded, isometric view of rocker switch including a self-contained actuator subassembly, a housing with molded light pipes and a printed circuit board base subassembly, in accordance with another embodiment of the invention.
Figure 10:
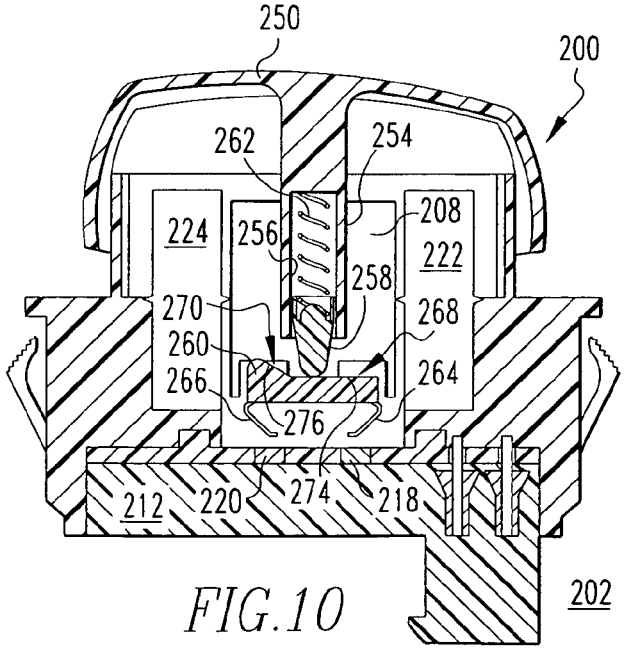
FIG. 10 is an assembled, cross-sectional side view of the assembly of FIG. 9, taken along line 10—10 of FIG. 9.

For example, FIGS. 9 and 10 illustrate a representative alternative embodiment of the actuator subassembly 200 and rocker switch 202 of the present invention. In this embodiment, like components are numbered substantially similarly to the reference numbering of the corresponding components in the previously disclosed embodiments, but under reference characters starting with 204. For example, the housing 204 corresponds to the housing 104 of the aforementioned embodiment. In the example of FIGS. 9 and 10, the housing 204 again defines a cavity 208 and includes an opening 209 providing access thereto. However, in this embodiment, the housing 204 further includes at least one light pipe 222,224 (best shown in FIG. 9) structured to illuminate the operating member 250. Two light pipes 222, 224 are shown in FIGS. 9 and 10. Additionally, the housing 204 houses a printed circuit board (PCB) 212. The terminals 214,216 are coupled to and in electrical communication with the PCB 212 and the PCB 212 is removeably coupled to the housing 204 in order that the stationary contacts 218,220 are disposed within the cavity 208 thereof (FIG. 10). This aspect of the invention provides even further customization capability of the actuator subassembly 200. For example, a variety of contact configurations and other electrical operating features can be programmed into the PCB 212 in order to further customize the operating characteristics of the rocker switch 202, while maintaining the desirable self-contained removable unit aspect of the invention. Additionally, as previously discussed, switches (e.g., switches 118, 120 of FIG. 5) could be employed rather than the stationary contacts 218,220 shown.

The remainder of the features of the actuator subassembly 200, apart from the somewhat different shape of the operating member 250 are substantially unchanged from the embodiments previously discussed herein. For example, the shaped member 260 is pivotally coupled to the extension 254 of the operating member 250 by engaging the aperture 255 thereof. The internal bore 256 and spring 262 and plunger 258 assembly moveably disposed therein, are also substantially similar. However, as best shown in FIG. 10, the shaped member 260 is different. Specifically, another example of an alternative shaped member 260 is shown.

In the example of FIG. 10, the shaped member 260 includes two shaped portions 268,270 having profiles 274, 276 which respectively define a sustained position and a momentary position. As previously discussed, the slope of the momentary profile 276 tends to cause the spring-biased plunger 258 to slide down towards the sustained profile 274 absent an external force being applied to overcome this tendency. This shaped member 260 configuration is representative of an application in which two operating member positions, one momentary and one sustained, is desired. It will, however, will be appreciated that, as with the embodiments previously discussed herein, the components of the embodiment illustrated in FIGS. 9 and 10 could have a variety of alternative configurations.

Figure 1:
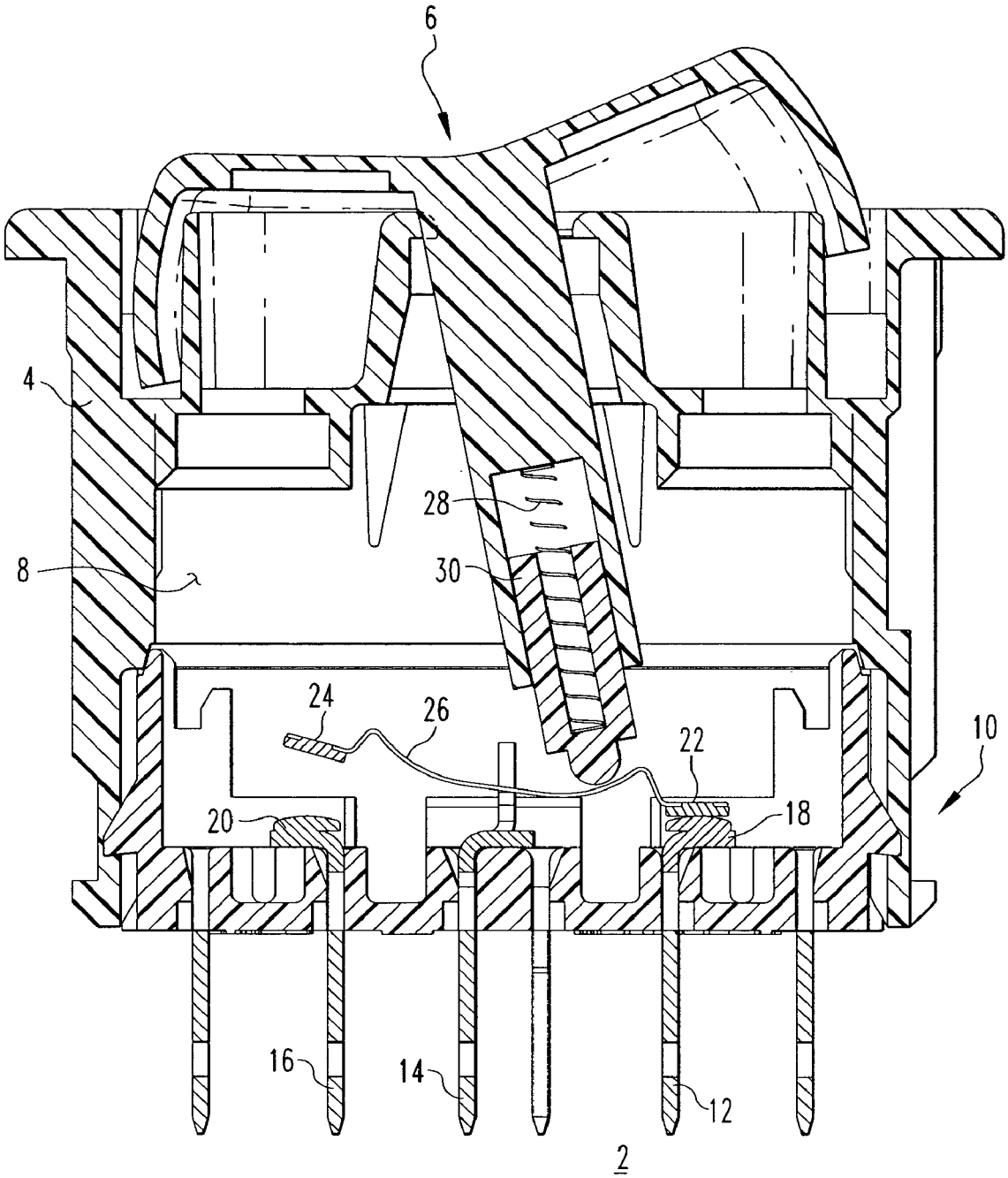
FIG.1 PRIOR ART
FIG. 1 is a cross-sectional side view of a rocker switch assembly.

As previously discussed, the button or operating member of a rocker switch can often be changed fairly easily, but the type of action of the switch (e.g., without limitation, momentary or sustained), for example, is dictated by a permanent assembly inside the switch housing (see, e.g., permanent shaped-member 26 within housing 4 of rocker switch 2 of FIG. 1). As was discussed herein, the present invention provides a subassembly in which the actuator or shaped member, which is the part that determines operating characteristics, such as the type of action, is coupled to the operating member in order to create a self-contained subassembly completely defining the operating characteristics of the switch. Therefore, the invention enables the manufacturer or end user to use a single, common switch body with the desired self-contained actuator subassembly in order to make a complete switch having the desired operating characteristics. Thus, the present invention allows the switch operating characteristics to be easily changed, even after the completed switch has been assembled and integrated into the final product.

Accordingly, the present invention provides an actuator subassembly which defines a self-contained unit interchangeably employable with the housing of a variety of rocker switches, in order to customize the operating characteristics thereof, as desired. Thus, the present invention also presents a rocker switch which may be customized or adapted, as desired, without having to replace the entire switch or disassemble or otherwise modify the end product in which it is disposed.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. An actuator subassembly for a rocker switch, said rocker switch including a housing defining a cavity with an opening which provides access thereto, a plurality of terminals which extend from outside said housing into said cavity and a contact element coupled to at least one of said terminals within said cavity, said actuator subassembly comprising:

an operating member operable between a plurality of positions, said operating member including an extension with an internal bore, said extension structured for insertion through said opening in said housing into said cavity thereof;

a plunger adapted for slidable insertion within said internal bore of said extension;

a shaped member pivotally coupled to said operating member and structured to define a plurality of operating characteristics thereof, including defining said positions thereof;

a spring disposed within the internal bore of said extension, said spring adapted to bias said plunger against said shaped member, in order that said plunger engages and moves said shaped member when said operating member is moved among said positions; and a contacting part coupled to said shaped member and structured to move therewith in order to engage said contact element of said rocker switch when said operating member is in a first one of said positions, wherein said operating member, said plunger, said spring, said shaped member and said contacting part form a self-contained unit structured to be removably inserted through the opening of said housing into said cavity thereof.

2. The actuator subassembly of claim 1 wherein said shaped member and said contacting part are operable between a first closed position in which said contacting part engages said contact element, and an open position in which said contacting part is spaced apart from said contact element; and wherein said first closed position of said shaped member corresponds to said first one of said positions of said operating member, and said open position corresponds to another one of said positions.

3. The actuator subassembly of claim 2 wherein said contact element is a switch; and wherein said shaped member and said contacting part thereon, are operable between said first closed position in which said contacting part engages and actuates said switch, and said open position in which said contacting part is spaced apart from said switch.

4. The actuator subassembly of claim 3 further including a printed circuit board wherein said plurality of terminals and said switch are coupled to and in electrical communication with said printed circuit board.

5. The actuator subassembly of claim 2 wherein said contacting part is a conductor; wherein said contact element is a stationary contact; and wherein said shaped member and said conductor thereon, are operable between said first closed position in which said conductor is in electrical communication with said stationary contact, and said open position in which said conductor is spaced apart fro said stationary contact.

6. The actuator subassembly of claim 1 wherein said operating characteristics are selected from the group consisting of said positions of said operating member, operating forces of said operating member, and types of action of said operating member.

7. The actuator subassembly of claim 1 wherein said shaped member includes at least two shaped sections corresponding to at least two of said positions of said operating member; wherein each of said at least two shaped sections has a profile; and wherein the profiles of said at least two shaped sections dictate the operating characteristics associated with the corresponding one of said at least two positions of said positions of said operating member.

8. The actuator subassembly of claim 7 wherein each of said at least two of said positions has an operating action; wherein said operating actions are selected from the group consisting of sustained and momentary; and wherein the profile of each of said shaped sections dictates whether said operating action for each of said at least two of said positions of said operating member is sustained or momentary.

9. The actuator subassembly of claim 8 wherein said at least two of said positions are first and second operating member positions; and wherein said first and second operating member positions have operating actions selected from the group consisting of a combination of two momentary actions, a combination of two sustained actions, and a combination of momentary and sustained actions, respectively.

10. The rocker switch of claim 9 wherein said extension of said operating member includes an aperture extending therethrough; and wherein said shaped member includes a pivotal portion which engages said aperture in order to pivotally couple to said extension and move therewith.

11. The rocker switch of claim 9 wherein said housing includes at least one molded light pipe structured to illuminate said operating member.

12. The actuator subassembly of claim 8 wherein said at least two of said positions are first, second and third operating member positions; and wherein said first, second and third operating member positions have operating actions selected from the group consisting of a combination of three sustained actions, a combination of two sustained actions and one momentary action, and a combination of two momentary actions and one sustained action, respectively.

13. The actuator subassembly of claim 1 wherein said extension of said operating member includes an aperture extending therethrough; and wherein said shaped member includes a pivotal portion structured to engage said aperture, in order to pivotally couple to said extension and move therewith.

14. A rocker switch comprising:

a housing defining a cavity and including an opening which provides access thereto;

a plurality of terminals extending from outside said housing into said cavity therein;

a contact element coupled to at least one of said terminals within said cavity; and an actuator subassembly comprising:

an operating member operable between a plurality of positions, said operating member including an extension with an internal bore, said extension inserted through said opening in said housing into said cavity thereof, a plunger slidably inserted within said internal bore of said extension, a shaped member pivotally coupled to said operating member and defining a plurality of operating characteristics thereof, including defining said plurality of positions thereof, a spring disposed within the internal bore of said extension, said spring biasing said plunger against said shaped member, in order that said plunger engages and moves said shaped member when said operating member is moved among said positions, and a contacting part coupled to said shaped member and movable therewith in order to engage said contact element of said rocker switch when said operating member is in a first one of said positions, wherein said operating member, said plunger, said spring, said shaped member and said contacting part form a self-contained unit which is removably inserted through the opening of said housing into said cavity thereof.

15. The rocker switch of claim 14 wherein said shaped member and said contacting part are operable between a first closed position in which said movable contact engages said contact element, and an open position in which said contacting part is spaced apart from said contact element; and wherein said first closed position of said shaped member corresponds to said first one of said positions of said operating member, and said open position corresponds to another one of said positions.

16. The rocker switch of claim 15 wherein said contact element is a switch; and wherein said shaped member and said contacting part thereon, are operable between said first closed position in which said contacting part engages and actuates said switch, and said open position in which said contacting part is spaced apart from said switch.

17. The rocker switch of claim 16 further including a printed circuit board wherein said plurality of terminals and said switch are coupled to and in electrical communication with said printed circuit board.

18. The rocker switch of claim 15 wherein said contacting part is a conductor; wherein said contact element is a stationary contact; and wherein said shaped member and said conductor thereon, are operable between said first closed position in which said conductor is in electrical communication with said stationary contact, and said open position in which said conductor is spaced apart fro said stationary contact.

19. The rocker switch of claim 15 wherein said at least two of said positions are first and second operating member positions; and wherein said first and second operating member positions have operating actions selected from the group consisting of a combination of two momentary actions, a combination of two sustained actions, and a combination of momentary and sustained actions, respectively.

20. The rocker switch of claim 15 wherein said at least two of said positions are first, second and third operating member positions; and wherein said first, second and third operating member positions have operating actions selected from the group consisting of a combination of three sustained actions, a combination of two sustained actions and one momentary action, and a combination of two momentary actions and one sustained action, respectively.

21. The rocker switch of claim 14 wherein said operating characteristics are selected from the group consisting of said positions of said operating member, operating forces of said operating member, and types of action of said operating member.

22. The rocker switch of claim 14 wherein said shaped member includes at least two shaped sections corresponding to at least two of said positions of said operating member; wherein each of said at least two shaped sections has a profile; and wherein the profiles of said at least two shaped sections dictate the operating characteristics associated with the corresponding one of said at least two positions of said positions of said operating member.

23. The rocker switch of claim 14 wherein each of said at least two of said positions has an operating action; wherein said operating actions are selected from the group consisting of sustained and momentary; and wherein the profile of each of said shaped sections dictates whether said operating action for each of said at least two of said positions of said operating member is sustained or momentary.

* * * * *